US006823989B2

(12) United States Patent
Wilder et al.

(10) Patent No.: US 6,823,989 B2
(45) Date of Patent: Nov. 30, 2004

(54) TWO CARTONS JOINED AS A SINGLE UNIT SEPARABLE INTO TWO SINGLE CARTONS

(75) Inventors: Duane Curtis Wilder, Chesterfield, VA (US); Frederick Ried Bruchbacher, Powhatan, VA (US); Claudette M. Calder, West Chester, PA (US); Joe Rush, Midlothian, VA (US); Lenny Lee Harris, Richmond, VA (US); Steven L. Brown, Montpelier, VA (US)

(73) Assignee: Philip Morris USA Inc., New York, NY (US)

( * ) Notice: Subject to any disclaimer, the term of this patent is extended or adjusted under 35 U.S.C. 154(b) by 57 days.

(21) Appl. No.: 10/417,606

(22) Filed: Apr. 17, 2003

(65) Prior Publication Data

US 2003/0217937 A1 Nov. 27, 2003

Related U.S. Application Data

(60) Provisional application No. 60/373,982, filed on Apr. 19, 2002.

(51) Int. Cl.[7] ..... B65D 85/10
(52) U.S. Cl. ..... 206/264; 206/271
(58) Field of Search ..... 206/264, 271, 206/273, 265, 268; 229/87.13

(56) References Cited

U.S. PATENT DOCUMENTS

| | | | |
|---|---|---|---|
| 4,631,900 | A | 12/1986 | Mattei et al. |
| 4,928,817 | A | 5/1990 | Focke |
| 4,932,534 | A | 6/1990 | Focke |
| 5,141,106 | A | 8/1992 | Adams et al. |
| 5,147,037 | A | 9/1992 | Evers et al. |
| 5,160,023 | A | 11/1992 | Adams et al. |
| 5,174,443 | A | 12/1992 | Chance et al. |
| 5,174,444 | A | 12/1992 | Adams et al. |
| 5,178,268 | A | 1/1993 | Talley et al. |
| 5,178,269 | A | 1/1993 | Evers |
| 5,178,270 | A | 1/1993 | Adams et al. |
| 5,178,271 | A | 1/1993 | Adams et al. |
| 5,180,055 | A | 1/1993 | Chance et al. |
| 5,180,056 | A | 1/1993 | Adams et al. |
| 5,201,413 | A | 4/1993 | DeBlasio et al. |
| 5,205,403 | A | 4/1993 | DeBlasio |
| 5,251,748 | A | 10/1993 | Adams et al. |
| 5,261,533 | A | 11/1993 | Adams et al. |
| 5,419,431 | A | 5/1995 | Neuber et al. |

*Primary Examiner*—Jacob K. Ackun
*Assistant Examiner*—J. Williams
(74) *Attorney, Agent, or Firm*—Connolly Bove Lodge & Hutz LLP

(57) ABSTRACT

A dual cigarette carton has overall dimensions compatible with commercially available tax-stamping machinery as well as structural features that enable subsequent separation of the dual carton into two five-pack cartons. The dual cigarette carton comprises first and second cartons each having relatively long front and back walls, an interconnecting bottom wall and narrow end walls. First and second cover flaps are connected to the front wall of the first and second cartons along upper edges thereof. The first and second cover flaps overlie one another when the cartons are positioned in back-to-back relationship. A perforated fold line extends between each cover flap and the front wall to which it is connected, and each perforated fold line includes an unperforated portion at one end thereof for strengthening connection between the cover flaps and the front walls as the cartons with cigarette packs therein pass through the tax-stamping machinery. The other end of each perforated fold line includes a slit to facilitate separation and removal of the flaps from the front walls of the cartons thereby producing two five pack cartons.

7 Claims, 4 Drawing Sheets

TWO CARTONS JOINED AS A SINGLE UNIT SEPARABLE INTO TWO SINGLE CARTONS

This application claims benefit of 60/373,982 filed Apr. 19, 2002.

BACKGROUND OF THE INVENTION

The present invention relates to cigarette cartons containing cigarette packs, and more particularly to the connection of two separate cigarette cartons to form a dual carton for tax stamp application to the packs and subsequent separation into two single cartons.

Cigarette packs which usually contain twenty cigarettes are generally rectangular in shape, having front and back long walls and two short side walls. Cigarette cartons typically contain two rows of five cigarette packs per row with each row arranged so that the front long walls of the packs are in the same plane and the back long walls are in a parallel plane spaced from the front long walls. Such cigarette cartons are generally known in the art as ten-pack cartons. These cartons are generally filled with cigarette packs by the manufacturer, temporarily closed (e.g., by folding the top flap of the carton over the cigarette packs and releasably securing the flap in the closed position), and shipped to various distributors. The distributors generally open the cartons to apply tax stamps to the upper ends of the individual cigarette packs inside the cartons as required by the jurisdiction in which they operate. Such procedures are commonly automated to reduce time, cost, and labor through the use of specially designed machines for applying tax stamps. Tax-stamping machines have been developed to open the cartons, apply the stamps, and finally seal the cartons for distribution to retail locations and the like. Such machines are generally commercially available, and are well known in the art. These machines have been developed for standard ten-pack cigarette cartons. A typical tax-stamping machine is model FUSON manufactured by Meyercord of 365 East North Avenue, Carol Stream, Ill. 60187.

Single row cigarette cartons which are dimensioned to contain one row of five cigarette packs with each pack usually containing twenty cigarettes and the packs arranged so that the front long walls of the packs are in the same plane and the back long walls are in a parallel plane spaced from the front long walls, i.e., five-pack cartons, are also known in the art. However, although machinery exists for manufacturing such cartons, machinery does not exist for stamping the cigarette packs contained in such cartons. Consequently, such cartons are usually put into scored, glued, and collapsed cartons to be hand-stamped, or secured together in pairs to be run through the existent tax-stamping equipment in which packs in double row cartons are stamped. To assure that the tax stamp is properly registered, the means for securing the cartons must be strong enough to keep the cartons together such that they are not sheared apart by the vertical rollers of the tax stamping machines which roll along the vertical walls of the cartons to transfer the cartons between the various stages of the process.

If two narrow cartons are to be secured together, the means for securement must allow for later separation of the cartons by the retailer or consumer. For marketing purposes, once separated, the two cartons should have little or no trace of the means for securement which would disfigure the outward appearance of the cartons.

SUMMARY OF THE INVENTION

It is therefore an object of the present invention to provide for the capability of manufacturing and distributing cartons narrower than those processed by existent tax-stamping machinery common to distributors, without requiring customized tax-stamping machinery or hand stamping of the packs.

It is a further object of the present invention to provide carton structure for securing two narrow cartons together to form a dual carton such that the two cartons do not move relative to one another while being transferred through tax-stamping machinery designed to process cigarette cartons having the dimensions of the dual carton.

It is still another object of the present invention to provide carton structure for making a clean separation between the two narrow cartons for sale as individual cartons.

It is still another object of the present invention to provide carton structure than enables opening of a dual carton for tax stamp application to cigarette packs therein without damage to the cover flaps of the carton and which enables easy separation of the dual pack carton into two narrow cartons at the point of sale.

These and other objects of the present invention are accomplished in accordance with the principles of the invention by releasably connecting two narrow cartons, such as five-pack cartons, together to form a dual carton, such as a ten-pack carton, which may be passed through commercially available tax-stamping machinery without carton damage.

A wide top closure flap is provided on one of the five-pack cartons and a narrow top closure flap is provided on the other five-pack carton. The flaps articulate about perforated fold lines that enable opening of the flaps for tax stamp application to the cigarette packs therein without carton damage, and subsequent closure of the flaps with adhesive therebetween. The perforated fold lines also enable top flap removal of the wide and narrow flaps as a single unit for easy and clean separation into two five-pack cartons. Each perforated fold line includes an absence of perforations a short distance from the end thereof where the flaps are initially opened for tax stamp application as well as a slit at the other end thereof to facilitate flap removal and easy separation into two five-pack cartons. The absence of perforations at the end where the flaps are opened strengthens the connection between the flaps and the surrounding carton material to prevent the flaps from being damaged during tax stamp application to the cigarette packs.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar referenced characters refer to similar parts and in which.

DETAILED DESCRIPTION OF THE INVENTION

Figure 1:
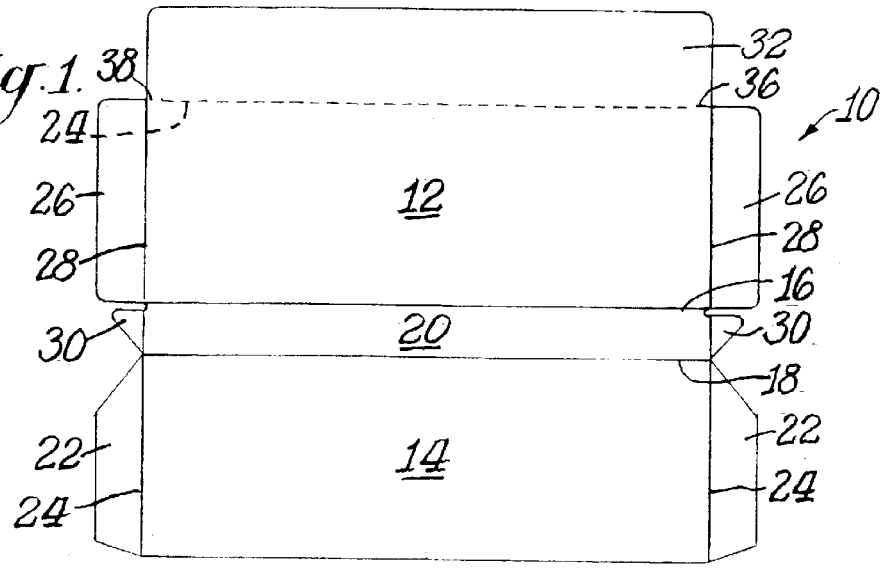
FIG. 1 is a plan view of one of two carton blanks for a five-pack carton, in accordance with the present invention.
Figure 2:
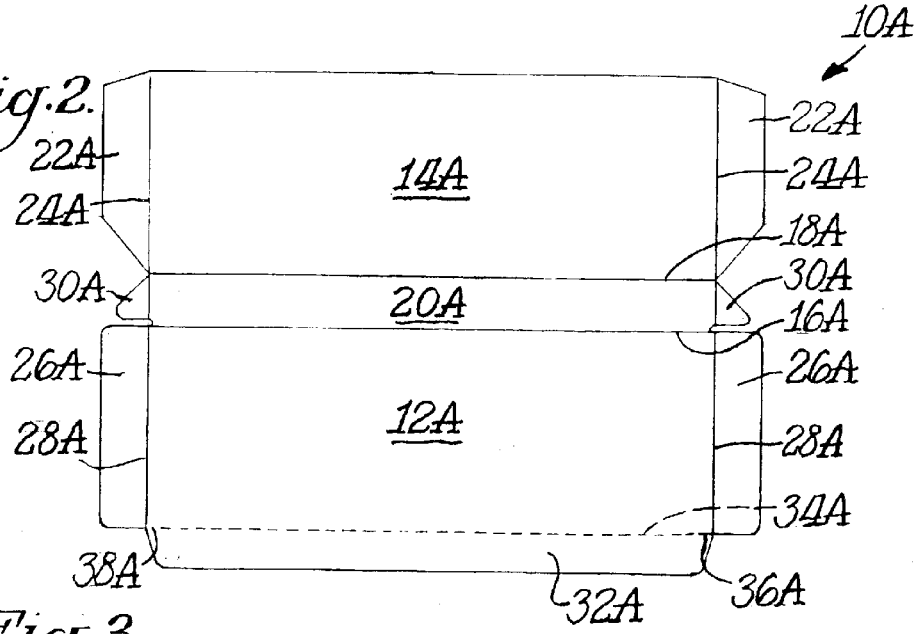
FIG. 2 is a plan view of the second carton blank for a five-pack carton, in accordance with the present invention.
Figure 3:
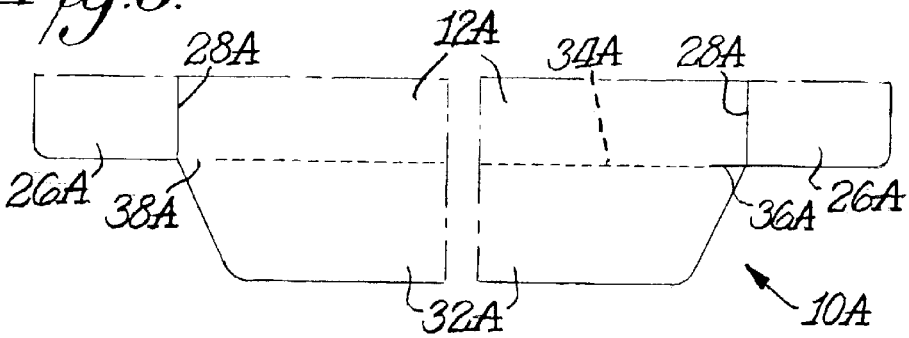
FIG. 3 is an enlarged fragmental view of the second carton blank of FIG. 2 showing the perforated fold line of the cover flap, the fold line having an unperforated leading edge for strengthening purposes and a slit at the trailing edge thereof for ease of cover flap removal.
Figure 4:
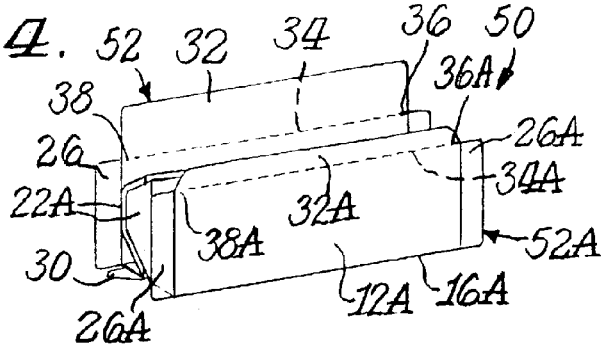
FIG. 4 is a perspective view showing the first and second five-pack cartons partially formed and in back-to-back relationship with one another.
Figure 5:
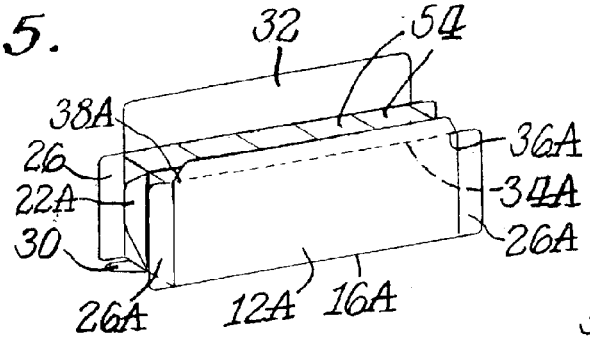
FIG. 5 is a perspective view similar to FIG. 4 showing cigarette packs positioned in the first and second five-pack cartons.

Referring in more particularity to the drawings, FIGS. 1 and 2 each show a five-pack cigarette blank 10, 10A for a carton adapted to hold one row of five cigarette packs, i.e., a five-pack. The blanks of FIGS. 1 and 2 are used to form a dual carton construction having overall dimensions similar to those of typical ten-pack cartons so as to enable tax stamp application to cigarette packs therein using standard tax stamp machinery. Blanks 10, 10A are preferably formed from substantially rigid material such as paperboard. Each relatively large front panel 12, 12A and rear panel 14, 14A is preferably five times the width of a long wall of a cigarette pack to be enclosed therein. As used herein, a standard cigarette pack is defined as any pack commonly used for holding a predetermined number of cigarettes, and generally having front and back long walls connected by two short side walls with each pack usually containing preferably twenty cigarettes.

Each blank 10, 10A is folded along respective fold lines 16, 16A and 18, 18A whereby front panel 12, 12A becomes parallel to rear panel 14, 14A. Joining panels 12, 12A and 14, 14A is an interconnecting bottom panel 20, 20A which forms the bottom wall of the carton when the blank is folded into a carton.

Blanks 10, 10A also include end closure flaps for closing the ends of each five-pack carton. Specifically, blank 10 of FIG. 1 includes inside closure flaps 22 connected to back panel 14 along fold lines 24 and outside closure flaps 26 connected to front panel 12 along fold lines 28. Similarly, blank 10A of FIG. 2 includes inside closure flaps 22A connected to back panel 14A along fold lines 24A and outside closure flaps 26A connected to front panel 12A along fold lines 28A. Bottom walls 20, 20A also include flaps 30, 30A, as shown.

Each blank includes a cover flap, and these flaps overlie one another when both five-pack cartons are positioned back-to-back, as explained more fully below. Blank 10 has a relatively wide cover flap 32 connected to front panel 12 along a perforated fold line 34 while blank 10A preferably has a relatively narrow cover flap 32A connected to front panel 12A along perforated fold line 34A. Cover flaps 32, 32A articulate about perforated fold lines 34, 34A to open and close the dual cigarette carton formed by the cartons of blanks 10, 10A.

As explained more fully below, it is significant that each line of perforations 34, 34A has a slit 36, 36A at one end thereof to facilitate removal of the cover flaps 32, 32A when separating the dual carton into two individual five-pack cartons. Preferably, the slit 36, 36A is approximately ⅛ to ⅜ inches long, preferably approximately ⅛ inch. Moreover, the other end of each line of perforations includes an unperforated portion 38, 38A for strengthening the closure flaps when opened and closed during application of tax stamps to the individual cigarette packs inside the dual carton. Preferably, the unperforated portion 38, 38A is approximately ⅛ to ⅜ inches long, preferably about ⅛ inch.

FIGS. 4–8 diagrammatically illustrate the sequence in forming a dual cigarette carton 50 from two individual cartons 52, 52A formed from blanks 10, 10A, respectively. Initially each carton 52, 52A is formed by folding along lines 16, 16A and 18, 18A so that front panel 12, 12A is parallel to rear panel 14, 14A. The partially formed cartons 52, 52A are then positioned in back-to-back relationship with back panels 14, 14A engaging one another. This assembly is shown best in FIG. 4.

The next step is loading cigarette packs 54 into the dual carton 50 with five packs in carton 52 and five packs in carton 52A. Bottom wall flaps 30, 30A together with inside end flaps 22, 22A are then inwardly folded. Outside end flaps 26, 26A are then secured to the inside end flaps 22, 22A by adhesive. An adhesive seal 56 is placed at each end of dual carton 50 to maintain the individual cartons 52, 52A in an assembled position. Preferably, the seal 56 includes a perforation line to facilitate separation of dual carton 50 into the individual cartons 52, 52A. Cover flaps 32, 32A are folded to their closed positions, and the dual carton 52 is ready for transport to a distribution center for application of tax stamps to the individual cigarette packs 54.

Figure 6:
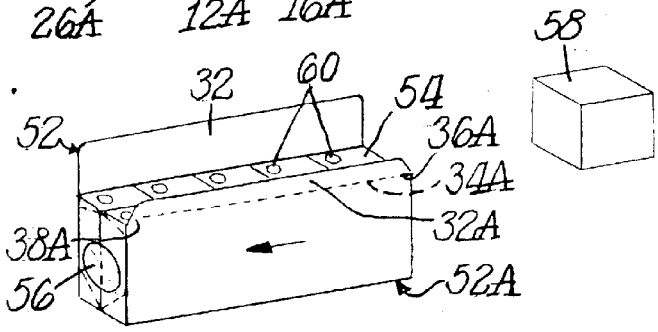
FIG. 6 is a perspective view similar to FIG. 5 showing the end flaps of each five-pack carton closed and glued together with an outer adhesive seal joining the cartons together at the closed ends thereof and tax stamps being applied to the cigarette packs.

FIG. 6 diagrammatically shows tax stamp machinery 58 for applying tax stamp 60 to the cigarette packs within the dual carton 50. The dual carton shown in FIG. 6 has just been processed and the tax stamps 60 have been applied. After such application of the tax stamps, cover flap 32A is first closed and then cover flap 32 is glued or otherwise secured to cover flap 32A, as shown in FIG. 7.

Figure 7:
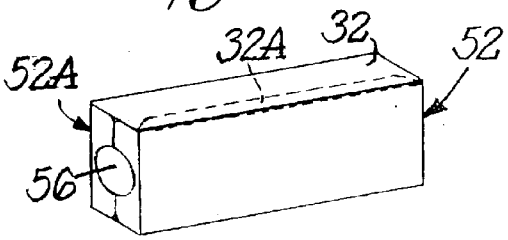
FIG. 7 is a perspective view illustrating the wide top flap of the first five-pack carton of FIG. 1 glued to the narrow top flap of the other five-pack carton of FIG. 2.
Figure 8:
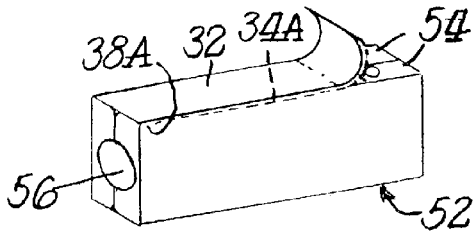
FIG. 8 is a perspective view illustrating removal of the top flaps as a single unit from the two five-pack cartons.

The assembled dual carton 50 of FIG. 7 may then be transported to its point of sale and at that time both cover flaps 32, 32A are separated as a unit by grasping one end and tearing along the perforated fold lines 34, 34A. Once the adhesive end seals 56 are removed or broken, the individual cartons 52, 52A stand alone for sale as individual five-pack cartons.

As explained above, the unperforated portions 38, 38A of perforated fold lines 34, 34A function to strengthen connection of the closure flaps 32, 32A to the surrounding carton material. Accordingly, when the dual carton 50 passes through the tax stamp machinery 58 the unperforated portions 38, 38A are located at the forward end of carton 50 as it travels through the tax stamp machinery from right to left in FIG. 6. This machinery operates to open and close the carton 50 as well as apply tax stamp 60 to the individual cigarette packs 54. Without such unperforated portions 38, 38A, the closure flaps might be torn or otherwise damaged during the opening and closing of the flaps at the high operational speeds of the tax stamp machinery. Moreover, it is to be understood that if the carton as shown in FIG. 6 were to be directed through the tax stamp machinery 58 from left to right, the slit 36, 36A and the unperforated portion 38, 38A would be mutually reversed.

The slits 36, 36A at the other end of each carton 50, 52 facilitate removal of the end flaps 32, 32A as a single unit at the point of sale when the dual carton 50 is separated into two five-pack cartons 50, 52A. The slits 36, 36A enable the retailer to reach under the sealed closure flaps 32, 32A at that end of dual carton 50 and thereby tear the closure flaps away from the front panels 12, 12A to which the flaps are connected by the perforated fold lines 34, 34A. The edge angle of the flaps at the other end of dual carton 50 are sufficiently shallow or blunt so as to maintain a glued together condition during flap removal.

Figure 9:
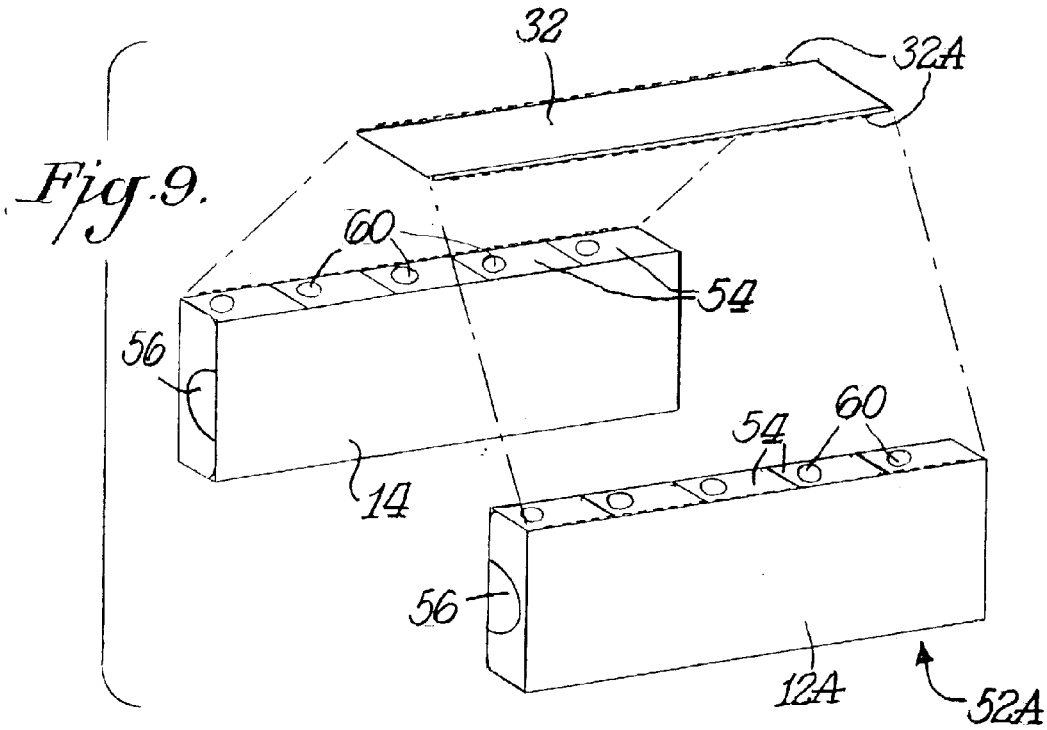
FIG. 9 is a perspective view showing the first and second five-pack cartons separated from one another after the top flaps are removed as a single unit and the ends seals are cut.

FIG. 9 diagrammatically shows separation of the dual carton 50 into the five-pack cartons 52, 52A. Each five-pack carton has a clean appearance and only one edge at the top of each carton shows any evidence of the perforated fold line. Specifically, the top edge of front panel 12, 12A shows some of the remains of the perforated fold line, but the top edge of the rear panel 14, 14A is without any such roughness.

Figure 10:
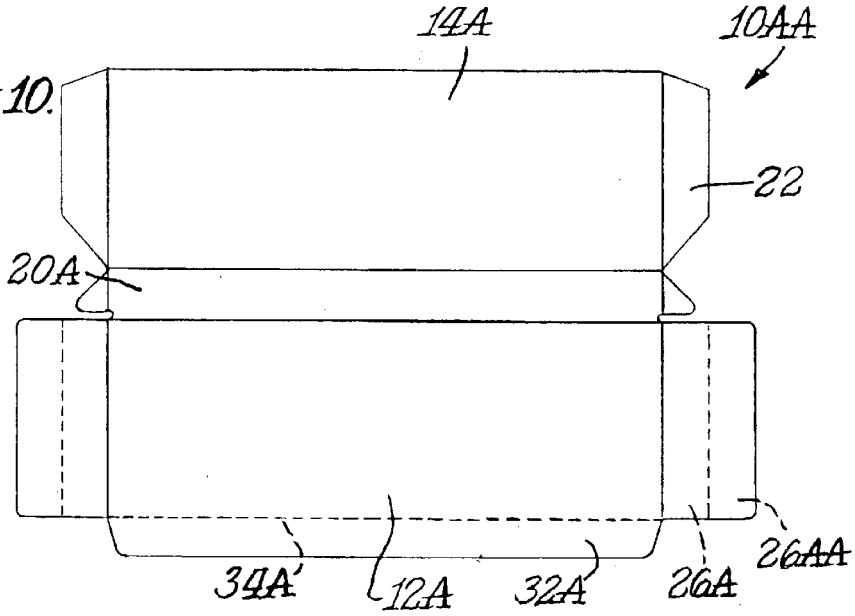
FIG. 10 is a plan view of a carton blank similar to FIG. 2, but illustrating an alternate embodiment of the present invention.
Figure 11:
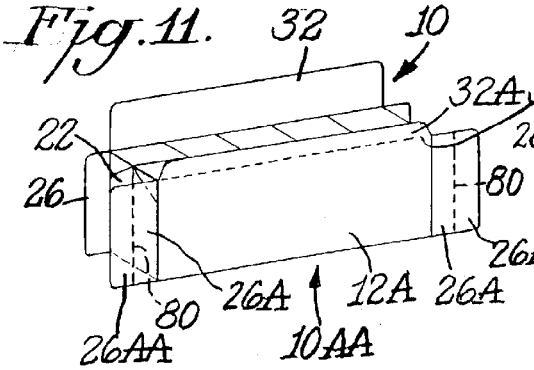
FIG. 11 is a perspective view showing the blanks of FIGS. 1 and 10 in back-to-back relationship with one another with cigarette packs in the cartons.
Figure 12:
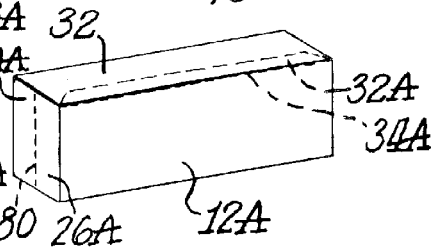
FIG. 12 is a perspective view showing the wide top flap of the carton of FIG. 1 glued to the narrow top flap of the carton of FIG. 10 with the wide end flaps of the modified carton glued to the end flaps of the other carton, according to the present invention.

FIGS. 10–12 illustrate an alternate embodiment of the present invention primarily comprising the combination of a 1×5 carton blank 10AA and a second 1×5 carton blank 10, as shown best in FIG. 1. Blank 10AA is similar in design to blank 10A of FIG. 2, but instead of single outside closure flaps 26A, carton blank 10AA includes wide closure flaps each of which includes an outside flap portion 26A and an outside flap portion 26AA. Fundamentally, blanks 10 and 10AA are folded into their desired configuration in the same matter as carton blanks 10 and 10A. However, with blank 10AA the wide outside closure flaps comprising portions 26A and 26AA extend across the ends of both of the cartons. Specifically, outside closure flap portion 26A is glued or otherwise secured to inside closure flap 22A of blank 10AA while outside closure flap portion 26AA is glued or otherwise secured to outside closure flap 26 of blank 10.

A perforated line of separation is located between outside closure flap portions 26A and 26AA. In operation after assembled cartons are filled with cigarette packs and secured together in the manner described above, the assembled dual carton construction may be transported to its point of sale. At that time, both cover flaps 32 and 32A are separated as a unit by grasping one end and tearing along the perforated fold lines 34, 34A. With the construction of FIGS. 10–12, the wide outside closure flaps comprising portions 26A and 26AA are then separated along perforated lines 80 and the individual cartons then stand alone for sale as individual 5-pack cartons. The wide outside closure flaps of carton blank 10AA eliminate the need for the adhesive end seals 56, described above.

While the invention herein has been illustrated and described in accordance with a preferred embodiment, it is well recognized that variations and changes may be made therein without departing from the invention as encompassed in the claims. In that regard, the closure flaps 32, 32A may be of the same width and sufficiently wide so as to overlap one another in their closed condition. Blanks 10 and 10A could then be identical to one another.

What is claimed is:

1. A dual cigarette carton comprising first and second cartons each having relatively long front and back walls, an interconnecting bottom wall and narrow end walls, a first cover flap connected to the front wall of the first carton along an upper edge thereof and a second cover flap connected to the front wall of the second carton along an upper edge thereof, the first and second cover flaps overlying one another when the cartons are positioned in back-to-back relationship, a perforated fold line between each cover flap and the front wall to which it is connected, each perforated fold line including an unperforated portion at one end thereof for strengthen connection between the cover flaps and the front walls, and a slit at the other end of each perforated fold line to facilitate separation and removal of the flaps from the front walls of the cartons.

2. A dual cigarette carton as in claim 1 wherein the cover flap of the first carton is relatively wider than the cover flap of the second carton.

3. A dual cigarette carton as in claim 1 wherein the first and second cartons are each dimensioned to contain a single row of five cigarette packs.

4. A dual cigarette carton as in claim 1 wherein the first and second cover flaps are secured together but separable along the perforated fold lines as a single unit from the front walls of the first and second cartons.

5. A dual cigarette carton as in claim 4 wherein the first and second cartons are each dimensioned to contain a single row of five cigarette packs.

6. A dual cigarette carton as in claim 1 wherein one of the first and second cartons includes wide end closure flaps extending across and secured to both cartons at the ends thereof.

7. A dual cigarette carton as in claim 6 wherein wide end closure flaps each include a perforated line of separation to facilitate separation of the cartons.

* * * * *